United States Patent [19]

Tsuchiya

[11] Patent Number: 4,480,909

[45] Date of Patent: Nov. 6, 1984

[54] POTENTIAL CONTROL ON PHOTOSENSITIVE MEMBER

[75] Inventor: Hiroaki Tsuchiya, Tokyo, Japan

[73] Assignee: Canon Kabushiki Kaisha, Tokyo, Japan

[21] Appl. No.: 459,690

[22] Filed: Jan. 20, 1983

Related U.S. Application Data

[63] Continuation of Ser. No. 241,420, Mar. 6, 1981, abandoned.

[30] Foreign Application Priority Data

Mar. 13, 1980 [JP] Japan ..... 55-32260
Apr. 1, 1980 [JP] Japan ..... 55-43095

[51] Int. Cl.[3] ..... G03G 13/02

[52] U.S. Cl. ..... 355/14 CH; 355/3 CH; 355/55; 355/77; 430/31; 430/902

[58] Field of Search ..... 355/14 CH, 3 CH, 55–57, 355/60, 77; 250/324–326; 430/31, 902

[56] References Cited

U.S. PATENT DOCUMENTS 3,496,351 2/1970 Cunningham ..... 250/49.5
3,564,239 2/1971 Kushima ..... 355/3 CH
3,614,222 10/1971 Post et al. ..... 355/60 X
3,649,114 3/1972 Vlach et al. ..... 355/14 CH
3,678,350 7/1972 Matsumoto et al. ..... 317/262 A
4,007,986 2/1977 Komori et al. ..... 355/60 X
4,158,114 6/1979 Suzuki et al. ..... 355/57 X
4,208,697 6/1980 Fischer et al. ..... 355/3 CH

FOREIGN PATENT DOCUMENTS 49-29467 8/1974 Japan .

*Primary Examiner*—R. L. Moses
*Attorney, Agent, or Firm*—Fitzpatrick, Cella, Harper & Scinto

[57] ABSTRACT

Disclosed herein is an electrophotography process for controlling the potential on a movable photosensitive member having a photoconductive layer to form a latent image on the photosensitive member. The moving speed of the photosensitive member is changed by setting a magnification changing mode, and, when the latent image is formed on the photosensitive member moving at the changed speed, a quantity of a first corona discharge applied to the photosensitive member is changed at a time prior to the latent image formation.

28 Claims, 5 Drawing Figures

POTENTIAL CONTROL ON PHOTOSENSITIVE MEMBER

This is a continuation of application Ser. No. 241,420, filed Mar. 6, 1981 now abandoned.

BACKGROUND OF THE INVENTION

1. Field of the Invention

This invention relates to an electrophotographic process which adopts a potential control technique by control of a discharge quantity from a corona discharger to the photosensitive member. More particularly, it is concerned with potential control on a photosensitive member used in an electrophotographic reproduction apparatus, for example, wherein, when a rotational speed of the photosensitive member is varied in accordance with a magnification changing ratio.

2. Description of Prior Art

In order to form a latent image having a predetermined electric on a photosensitive member, the conventional potential control has been done in such a manner that a latent image having bright and dark patterns is first formed on the photosensitive member, a potential of the thus formed latent image is measured by a potential sensor, and a corona discharge quantity to be applied to the photosensitive member is varied until a desired potential value is reached. Variations in this corona discharge quantity are so controlled that the latent image having both bright and dark patterns may be converged on a predetermined electric potential. For this purpose, the conventional potential control method should repeat over a plurality of numbers of times those steps of: experimental latent image formation, potential detection, and change in current applied to a discharger, and, as soon as conditions have been fixed, they are held in a holding circuit. Further, the potential control in the conventional electrophotographic method is also used for converging a varying electric potential on a predetermined target value.

In the following, explanations will be made as to a case, wherein a moving speed of the photosensitive member, i.e., the process speed, is varied for image reproduction in a changed magnification.

Heretofore, the potential control has been done with fixed constants (such as target potential, initial value, control factors, etc.) necessary for the potential control on the basis of, for example, an equal magnification (1:1 scale) as a standard, and, even when the process speed should be changed at the magnification changing mode, it has been done with such fixed constants. Even with such control method, the potential control can be done for either case of the equal magnification and changed magnification, since the potential contrast can be constantly controlled irrespective of the process speed. Practically, however, if an initial value is fixed, an initial charge quantity varies with change in the process speed with a consequence that a longer time than in the case of the equal magnification is taken until a predetermined potential is reached. In general, those conditions such as a bias voltage value at the side of the developing means, a number of revolutions of a developing sleeve, and others are fixed. As the result, a difference would come out in the developed images due to variations in the process speed, even if the latent image contrast is constant. For instance, at the time of magnification, or enlargement, the process speed becomes lower than a standard value and the charge quantity increases substantially. Therefore, when the initial charge quantity is constant, a longer time than at the standard process speed is required for an increase in this initial charge quantity, until the potential control is terminated and a constant contrast is obtained. Also, in case a constant contrast is reached in a state of the process speed being slowed down, if the developing conditions are constant, the image quality becomes such that its density is higher and the background is stained with more fogging than in the case of the standard process speed, because the latent image is subjected to more development for a portion of the slowed-down speed. In the case of scale-reduction, on the contrary, since the process speed becomes increased, the initial charge quantity becomes lower than in the case of the standard process speed. This leads to prolongation of the time until completion of the potential control same as mentioned above. Furthermore, when the potential of the photosensitive member has reached a predetermined constant contrast, the image quality will be such that its density is generally low and an intermediate color tone tends to run out, if the development conditions are constant, because of increased process speed. For such reasons, when the process speed is variable, it is inconvenient to maintain the control constants fixed.

SUMMARY OF THE INVENTION

It is therefore an object of the present invention to provide an electrophotographic process capable of obtaining a high quality image, even when the process speed changes at the magnification changing.

It is another object of the present invention to provide an electrophotographic process, which can successfully shorten a time for reproducing such image as mentioned above.

It is still another object of the present invention to provide a potential control method which solves the above-mentioned problem, and produces a first or initial copy of a stable image quality in a short period of time, even if the process speed changes between the equal magnification and the changed magnification.

With a view to attaining the abovementioned objectives, the present invention provides an electrophotographic method for forming a latent image on a photosensitive member having at least an electrically conductive layer and a photoconductive layer, wherein, when the process speed is varied at the magnification changing in accordance with a magnification changing ratio, a quantity of corona application to the photosensitive member is varied in accordance with the changed process speed, whereby, when a potential curve of the latent image to be a reference on the photosensitive member is varied, (1) the first such corona application is set as a predetermined quantity in accordance with a magnification changing ratio so as to effect the potential control from this corona application, or (2) a value obtained from multiplication of a corona application quantity obtained by the potential control at the equal magnification with a value in accordance with the magnification changing ratio is made the corona application quantity for the latent image formation.

That is to say, in case of changing the magnification changing ratio from equal magnification to a scale reduction, or enlargement, if the abovementioned potential control is to be done by applying to the discharges a voltage or current which is the same as at the equal magnification, so as to control the potential on the photosensitive member to a potential specific to the magnification change, a long time is taken until a necessary specific value is reached. In this respect, the present invention makes it possible to determine the applying voltage to the corona discharger under desired conditions and in the shortest possible time.

DETAILED DESCRIPTION OF PREFERRED EMBODIMENTS

In the following, the present invention will be explained in detail in reference to preferred embodiments thereof.

Figure 1:
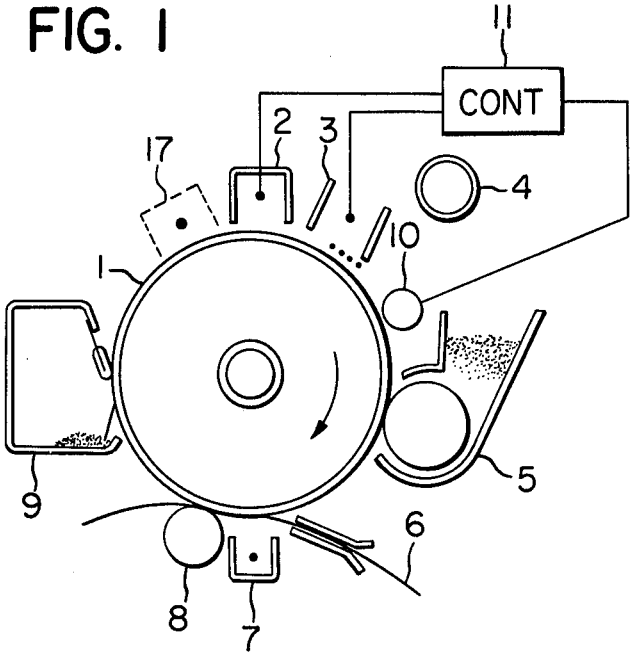
FIG. 1 is a schematic cross-sectional view of the main part of a reproduction apparatus, in which the present invention is adopted.

Referring to FIG. 1, a reference numeral 1 designates a drum-shaped photosensitive member which rotates in an arrowed direction. The photosensitive member 1 is composed of an electrically conductive substrate, a photoconductive layer on the substrate, and a surface insulative layer on the photoconductive layer. Since this type of the photosensitive member is fully disclosed in Japanese patent publication No. 42-23910 (corresponding to U.S. Pat. No. 3,666,363), reference may be had to the publication for any detailed explanations thereof.

A latent image corresponding to an image original is formed on this photosensitive member 1 by d.c. corona from a first corona discharger, a.c. corona from a second corona discharger, irradiation of the image original, and an overall light irradiation by a lamp 4. The latent image on the photosensitive member is then toner-developed by a developer 5, and the developed image is transferred onto an image transfer material 6 under electric field due to a discharger 7. The image transfer material 6, on which the developed image has been transferred, is separated from the photosensitive member by a separation roller 8 and conveyed to an image fixing device (not shown) where the toner is fixed, thereby completing the reproduction. On the other hand, residual toner on the photosensitive member 1 is removed by a cleaning device 9, and the photosensitive member is ready for subsequent use.

In the abovementioned reproduction apparatus, a well known potential sensor 10 is situated at the downstream side of the corona discharger 3 to detect the electric potential of the latent image on the photosensitive member 1. The potential sensor 10 measures a latent image potential $V_D$ of the photosensitive member and a latent image potential $V_L$ corresponding to a white original in a state of an image original exposure lamp being turned off. The measured values are fed back to a control section 11 (to be mentioned later) to form a latent image of a predetermined potential on the photosensitive member. In other words, at the control section 11, the abovementioned values $V_D$ and $V_L$ are controlled to reach target values by varying the current quantity applied to the first and second dischargers 2, 3 based on the abovementioned measured values. At the stage of the values $V_D$ and $V_L$ having reached the target values, the image original is exposed on the photosensitive member for the latent image formation, whereby the latent image having a predetermined potential can be formed on the photosensitive member. The voltage application to the dischargers 2, 3 is done by varying an output from a high tension transformer through the control section 11.

Formation of bright and dark patterns on the photosensitive member can be done in such a manner that the dark portion (blank original) is formed at the time of non-exposure, and the bright portion (white original) is formed at the time of blank exposure. In the device according to the present invention, the voltages to be applied to the first and second dischargers 2, 3 are varied until the values measured by the sensor 10 reach predetermined ones, and, at the stage where a latent image of a predetermined potential has been obtained, the image original is actually exposed, for the first time, on the photosensitive member 1 to form thereon the latent image for the image reproduction.

By adopting the abovementioned control method, it becomes possible to form a latent image of a predetermined potential, even when conditions of the atmosphere or sensitivity characteristics of the photosensitive member varies. This control method is disclosed in Japanese patent application No. 53-103041 (corresponding to U.S. Ser. No. 68,416, West German patent application No. P2934337, and British patent application No. 79.29344). Therefore, reference may be had to these applications for details.

In the following, the potential control method according to the present invention will be described in further details, taking a case of obtaining a magnification changing ratio a as an example. In this case, the operation is started from depression of a selection button, prior to the copying operation, to obtain the magnification changing ratio a.

When obtaining the magnification ratio a, the target potential values at both dark and bright portions (potentials intending to bring these portions to such-and-such values prior to commencement of the reproduction) are established beforehand at $V_{D0a}$, $V_{L0a}$. Then, in advance of exposure of the image original, electric current is applied to the first and second dischargers 2, 3 to form on the photosensitive member a latent image having dark and bright portions. For the initial current, in particular, for the first and second dischargers, use is made of outputs $I_{p1a}$, $I_{s1a}$ of determined values. With these outputs, when the potentials at the dark and bright portions respectively assume values $V_{D0a}$, $V_{D1a}$, the control thereafter is done by varying a high tension output current to the first and second dischargers 2, 3 so that a difference between $V_{D0a}$ and $V_{D1a}$ as well as a difference between $V_{L0a}$ and $V_{L1a}$ may be converged on zero. When the output current values for the first and second dischargers for the second time are $I_{p2a}$, $I_{s2a}$, the control equations for finding the output current values $I_{p2a}$ and $I_{s2a}$ are as follows.

$$I_{p2a}=\alpha_{1a}(V_{D02}-V_{D1a})+\alpha_{2a}(V_{L0a}-V_{L1a})+I_{p1a}$$

$$I_{s2a}=\beta_{1a}(V_{D0a}-V_{D1a})+\beta_{2a}(V_{L0a}-V_{L1a})+I_{s1a}$$

(In the above equations, $\alpha_{1a}$, $\alpha_{2a}$, $\beta_{1a}$, and $\beta_{2a}$ are respectively control factors to be determined by the characteristics of the photosensitive member to be used.)

Further, the potential control for n numbers of times can be expressed by the following general equations.

$$I_{p(n+1)a}=\alpha_{1a}(V_{D0a}-V_{Dna})+\alpha_{2a}(V_{L0a}-V_{Lna})+I_{pna}$$

$$I_{s(n+1)a}=\beta_{1a}(V_{D0a}-V_{Dna})+\beta_{2a}(V_{L0a}-V_{Lna})+I_{sna}$$

By repeating the abovementioned potential control, the potentials at the target values can be obtained.

In the above-described potential control, when the magnification changing ratios b and c are chosen, it may suffice to substitute b or c for a in the above equations. Here, the magnification changing ratio b is designated as a standard magnification, i.e., equal magnification, on the march of which the ratio a is designated as the enlarging side and the ratio c is designated as the reducing side. In other words, the magnification changing ratio is in a relationship of a>b>c. In correspondence to this relationship, when the rotational speed of the photosensitive member is Sa, Sb, and Sc, the relationship among these rotational speeds will be as follows: Sc>Sb>Sa. Hence, the following relationship can be established.

$I_{p1a}<I_{p1b}<I_{p1c}$ $I_{s1a}<I_{s1b}<I_{s1c}$

Figure 2:
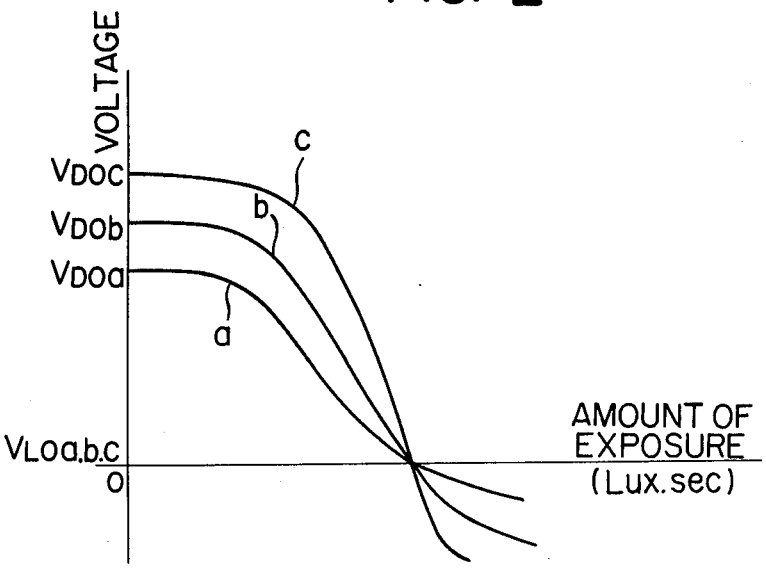
FIG. 2 is a graphical representation showing a relationship between potential and light amount.

It may be preferred that the value $V_{D0}$, for example, as one of the potential target values, be set in a relationship of $V_{D0a}<V_{D0b}<V_{D0c}$, because the developing capability becomes lower as the rotational speed of the photosensitive member becomes higher. Further, the corrective factors $\alpha_1$, $\alpha_2$, $\beta_1$, and $\beta_2$ may be selected at appropriate values in accordance with interrelationship between the photosensitive member and constants other than these corrective factors. FIG. 2 indicates the potential curves in each of the magnification changing ratios a, b, and c. As shown therein $V_{Loa1}$ $V_{LOb1}$ and $V_{Loc}$ are all equal to each other. If the values of the output currents $I_{p(n+1)}$, $I_{s(n+1)}$ at each of the magnification changing ratios a, b, and c are held for a certain definite time or longer so as to make them the initial output values for the subsequent potential control, the control precision can be improved.

When the potential control is conducted using a single factor out of $I_{p1}$, $I_{s1}$, $\alpha_1$, $\alpha_2$, $\beta_1$, and $\beta_2$ for each of the mode curves a, b and c without adopting the construction of the present invention, the values $V_{D0}$ and $V_{L0}$ differ on each of the magnification changing ratios with the consequence that a long time is taken for obtaining the target values from the initial formation of the latent image, hence rapid control cannot be expected.

Figure 3:
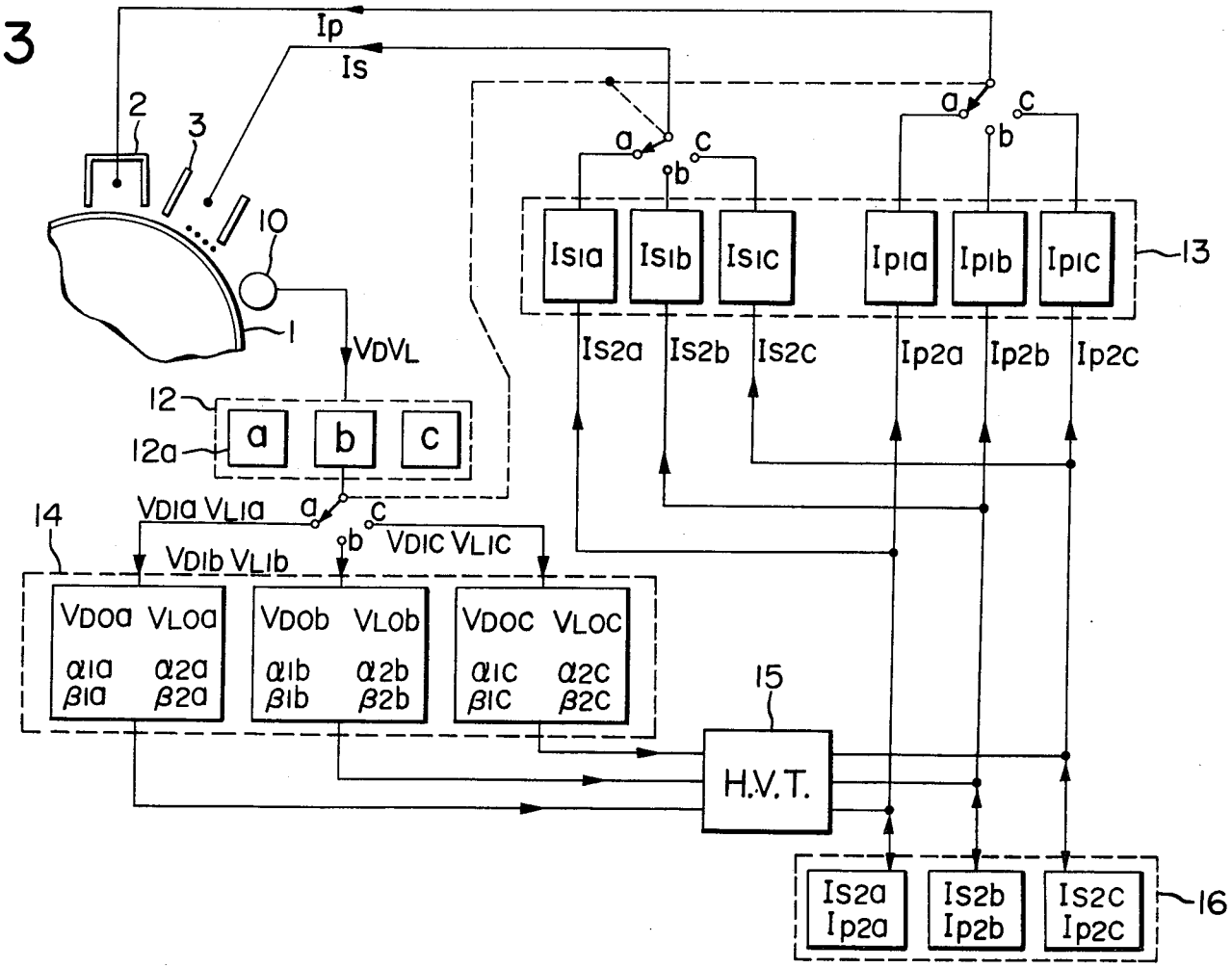
FIG. 3 is a block diagram showing a circuit construction for driving the reproduction apparatus.

FIG. 3 is a block diagram for explaining the operations of the embodimental construction according to the present invention.

In case an operator operates the reproduction apparatus in accordance with a magnification changing ratio, represented by the curve a in FIG. 2, a switch 12*a* for the mode "a" is first selected out of switches 12, and depressed. By the selection of the switch 12*a*, an initial current setting circuit 13 operates in association therewith, and set in a manner to obtain an output corresponding to the switch 12*a*. Then, the initial current is determined as $I_p$ for the first discharger 2, and $I_s$ for the second discharger 3, whereby a latent image having both dark and bright portions is formed by these currents $I_p$ and $I_s$ which are proximate to the target values.

The latent image pattern thus formed on the photosensitive member 1 has its dark and bright potentials $V_{D1a}$ and $V_{L1a}$ detected by the sensor 10. Based on these measured values, an output from a high tension transformer 15 is so controlled that the potential on the photosensitive member 1 may reach the target values $V_{D0a}$ and $V_{L0a}$ in an operationsl circuit 14. The output currents from the high tension power transformer when the potentials have reached the target values are represented by $I_{p2a}$ and $I_{s2a}$. The current values are maintained in a holding circuit 16 to be used as outputs during the copying operation and as initial currents in the subsequent control.

In the device shown in FIG. 3, the potential curve a is obtained by depressing the button 12*a* for the magnification changing ratio a. For the magnification changing ratios b or c, the button b or c is pushed down, whereby the potential curve b or c can be obtained.

For the photosensitive member, the three-layer structure consisting of the substrate, the photoconductive layer, and the surface insulative layer has been exemplified. Besides this, a two-layer structure of an electrically conductive layer and a photoconductive layer, and other structures may be used, in which case a similar effect can also be attained by controlling the charging quantity before the exposure.

As stated in the foregoing, according to the present invention, when the process speed is varied at the time of magnification changing, the potential of the photosensitive member can be controlled to a predetermined contrast under this varied speed. Therefore, the time for setting the initial condition can be shortened in comparison with that of the conventional methods.

In the above-described embodiment, since electric currents to obtain latent image potentials close to the target values are applied to each of the corona dischargers in accordance with the magnification changing ratio for image reproduction in a changed magnification, the potential control time is apparently and effectively shortened in comparison with a type, wherein currents at constant values are applied at the first corona discharging. In addition, since the potential control is done at every magnification changing, high quality image can be formed.

The following embodiment provides a method, wherein the potential control can be done in a much shorter time when the process speed changes.

In this method, the potential control is limited to the potential control at the equal magnification, even if the process speed differs between the equal magnification and the changed magnification. That is to say, at the time of the magnification changing, the high tension output for the equal magnification is varied at a certain ratio in accordance with the process speed for the changed magnification, whereby the initial copy can be obtained quickly, at a cheap cost, and with a stable image quality.

In the above-described apparatus, the initial charging quantity on the photosensitive member 1 by the first and second dischargers 2, 3 is determined by the current values $I_{p1}$, $I_{s1}$ to be applied to the dischargers 2, 3, respectively. In this instance, it is assumed that the potential of the latent image completed on the photosensitive member 1 is $V_{D1}$ at its dark portion and $V_{L1}$ at its bright portion. In order to bring the potentials of the latent image at its dark and bright portions to be proximate to the target values $V_{D0}$, $V_{L0}$, the abovementioned initial currents $I_{p1}$ and $I_{s1}$ are varied. As the result of this control, the ultimate outputs are assumed to be $I_{p2}$ and $I_{s2}$.

Then, the control circuit holds these output values $I_{p2}$ and $I_{s2}$ for the latent image formation.

The abovementioned potential control is done only at the time of the equal magnification reproduction. That is, at the equal magnification, the currents applied to the first and second dischargers are represented by $I_{p2}$, $I_{s2}$, whereby the latent image is formed. Incidentally, after completion of the potential control, the potential at the bright (white) portion is measured to vary the developing bias in correspondence to this measured result, whereby more stable image can be formed.

In the following, the potential control at the time of the changed magnification reproduction by the same device will be explained.

If the peripheral speed of the photosensitive member at the equal magnification is M mm/sec., it should be changed to N mm/sec. ($M \neq N$) at the changed magnification for the abovementioned reasons. At this instant, if the ultimate values of the current to be applied are determined as $I_{p2}$ and $I_{s2}$ by changing its quantity from the initial values as is the case with the equal magnification, the potential control at the changed magnification necessitates a time equal to, or longer than, that at the equal magnification. Therefore, the potential control of the present invention is done by converting the current values $I_{p2}$ and $I_{s2}$ for forming a latent image used for actual reproduction to those values of $I_{p2} \times (N/M)$ and $I_{s2} \times (N/M)$, respectively. In the same manner, the currents applied to both image transfer discharger and pre-charge-removing discharger 17 (illustrated by a chain line in FIG. 1) are converted to values multiplied by (N/M). Incidentally, the latent image potentials at both dark and bright portions on the photosensitive member at the abovementioned changed magnification are represented by $V_{D0}$ and $V_{L0}$, which are equal to the potentials at the equal magnification. As regards the quantity of light irradiation to the image original, since it has changed from a pre-set value in accordance with magnification, adjustment of the development bias by measuring the potential at the white portion is done in the same manner as at the equal magnification as already mentioned in the foregoing.

According to the present invention, since the potential control need not to be adjusted again from the initial state at the changed magnification, the control time can be shortened and the initial copy can be obtained quickly. Further, even in the presence of numerous magnification changing modes, since it may suffice that the conversion ratio of the ultimate values $I_{p2}$ and $I_{s2}$ be preset in accordance with a ratio of the process speed at the changed magnification to that of the equal magnification, any complication in the electronic circuit can be avoided.

The foregoing explanations are for the case, wherein the conversion is done for a predetermined quantity in utilization of the process speed ratio so that the potentials at both dark and bright portions on the photosensitive member may constantly assume the values of $V_{D0}$ and $V_{L0}$ even at the changed magnification. In general, however, when the process speed changes, if the developing characteristics are constant, there is such a tendency that the slower the process speed is, the larger is the developing capability, or conversely, the faster the process speed is, the smaller becomes the developing capability. Accordingly, the conversion ratio is not necessary to be fixed on the process speed ratio, but the optimum value of the ratio to be changed may be selected, for the conversion, in consideration of the developing characteristics.

Figure 4:
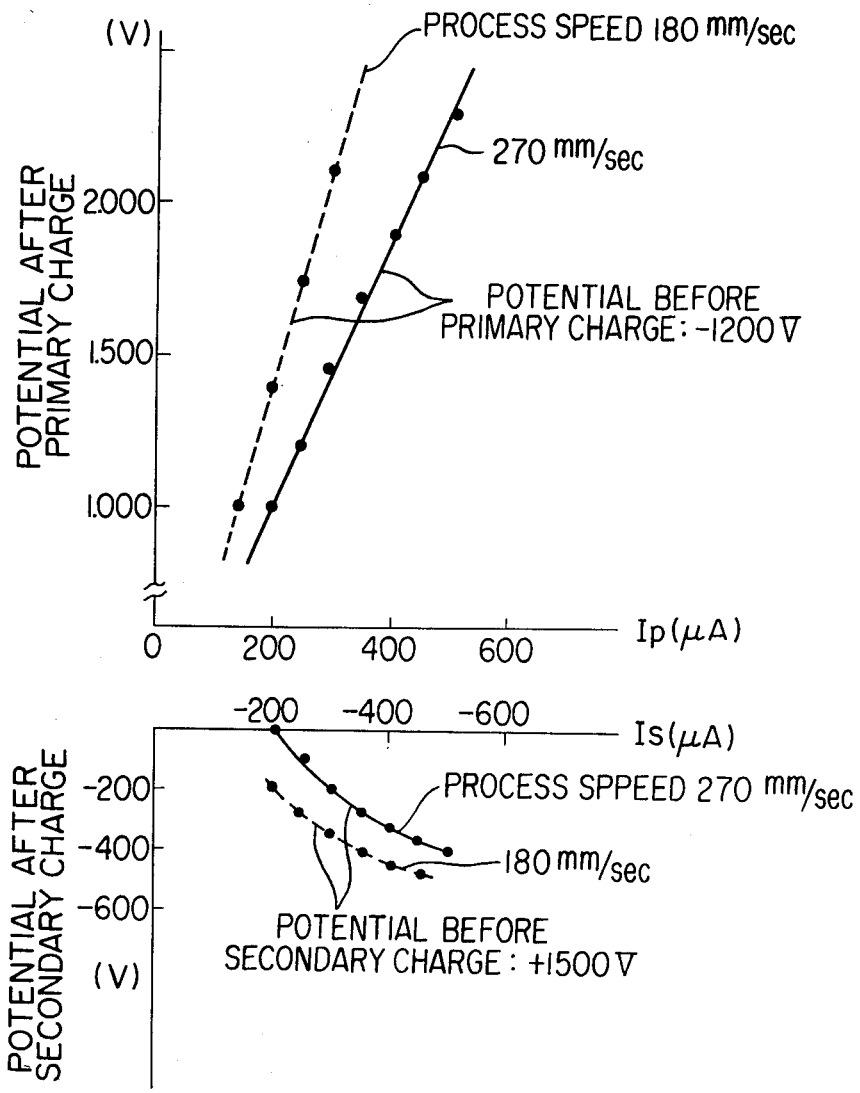
FIG. 4 is a graphical representation showing a relationship between process speed and electric charging quantity.

Referring to FIG. 4 which is a graphical representation showing the current versus potential characteristics which are the closest to the target values of the primary and secondary dischargers in case of the process speeds being 270 mm/sec. and 180 mm/sec., respectively. The graph shows comparisons of the current versus potential characteristics at the changed magnification with respect to those at the equal magnification, provided that, of the two process speeds, the speed of 270 mm/sec. is for the equal magnification and the other speed of 180 mm/sec. is for the changed magnification of scale-reduction. From this graphical representation, it will be found out that the process speed obtained by multiplication of 180/270, i.e., approximately 0.67, substantially corresponds to the current versus potential characteristics at 180 mm/sec. From this, when a hold value at the equal magnification is multiplied by a certain definite ratio relative to the process speed (in this case, approx. 0.67 times), there can be obtained on the photosensitive member 1 a potential of the same degree as at the equal magnification even in case of the changed magnification.

Figure 5:
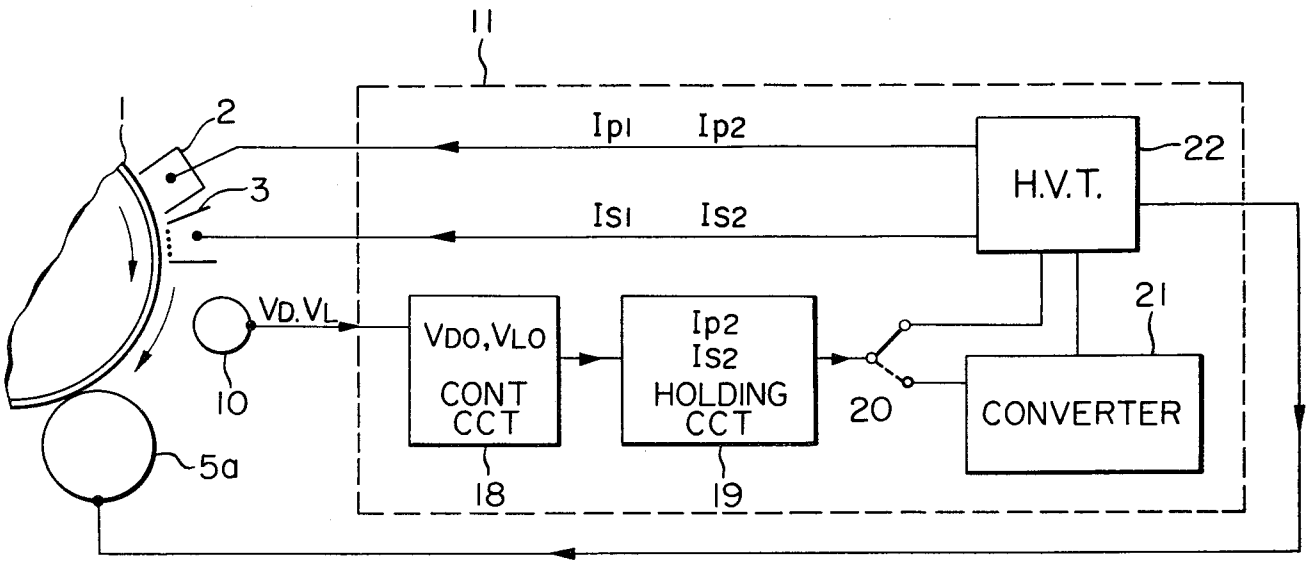
FIG. 5 is a block daigram of a circuit for the control section for the embodiment of the apparatus as shown.

Referring now to FIG. 5 which shows the block diagram of the control section 11 in the above-described embodiment, the sensor 10 detects the initial potentials $V_D$ and $V_L$ experimentally formed on the photosensitive member, and the potentials as detected are so controlled as to be brought closer to the target potential values $V_{D0}$ and $V_{L0}$ respectively by the control circuit 18, whereby the ultimate high tension output are determined as $I_{p2}$, $I_{s2}$, respectively. These ultimate output values are held in the holding circuit 19 for a certain definite time. A change-over switch 20 for the equal and changed magnifications is associated with change-over of the process speed. At the time of the equal magnification, the output from the holding circuit is directly introduced into the high tension transformer 22. On the other hand, at the time of the changed magnification, the switch is changed over to the side of the chain line with variations in the process speed, and the values $I_{p2}$, $I_{s2}$ are caused to be changed to values preset in correspondence to the process speed as mentioned above, and then introduced into the high tension transformer 22. Thus, predetermined current and voltage are applied to the electrodes of the corona dischargers 2 and 3 so as to obtain the latent image at the target potentials $V_{D0}$, $V_{L0}$ on the photosensitive member at both equal and changed magnifications.

In FIG. 5, the change-over switch 20 is for selecting two arbitrary modes. In case, however, a plurality of magnification changing modes are present, it may suffice that the number of the hold value converter 21 or the optimum values of the conversion ratio be established in corresponding numbers and kinds so that selectable objects by the switch 20 may be increased for a predetermined output.

According to this embodiment as described in the foregoing, the potential control need not be done again at the changed magnification reproduction within a certain definite time period by effecting the potential control once at the equal magnification reproduction and holding the potential and voltage for output for a certain definite time to obtain target values $V_{D0}$ and $V_{L0}$. In this way, the time for completing the initial copy in the changed magnification can be shortened. Further, according to the embodiment, once the potential control is done at the equal magnification reproduction, there is no necessity for doing it again at the changed magnification. Also, the electronic circuit is constituted with the converter alone, which simplifies the construction of the device. This provides the reproduction apparatus at a cheap cost and with high operating stability. Further, more stable image quality will be obtainable, if current and voltage to be applied to those dischargers such as, for example, the image transfer discharger and the precharge-removing discharger, other than those for electric charging relative to the potential control such as primary and secondary chargers, or high quantity from the exposure light source is varied at an established ratio. Moreover, when the developing bias is controlled in consideration of a potential corresponding to the white background at the changed modification, it is effective for preventing the fogging which tends to occur readily at the time of development. As to the photosensitive member, it is not only limited to the abovementioned three-layer structure, but also a two-layer structure of the electrically conductive layer and a photoconductive layer. Also, the photosensitive member and the latent image forming process are not restricted to the embodiment as described in the foregoing.

According to the present invention as described in the foregoing, potential control of high efficiency can be realized even with an electrophotographic apparatus having a magnification changing function, in which the moving speed of the photosensitive member is varied. The current and voltage applied to the corona dischargers which have been established through the potential control in the manner as mentioned with reference to the embodiment are held in the holding circuit for a certain definite time, whereby the potential control need not be done at every image formation. The actual holding can be done by adopting an analog type memory using a capacitor, etc., or a digital type memory using RAM (Random Access Memory). The holding time can be arbitrarily set by memory means, which may be determined in consideration of frequency of use of the apparatus, environmental changes, and others. In general, it may be appropriately 30 minutes to a few hours. The applicable field of the present invention is in an electrophotographic apparatus having a magnification changing function such as reproduction apparatuses and other recording apparatus, wherein the moving speed of the photosensitive member varies in conformity to the magnification changing mode.

What I claim is:

1. An electrophotographic process for forming images on an electrophotographic photosensitive member which has been charged by a corona discharging means, wherein said process is selectively operable in a first mode in which an image of an original is formed with a first magnification, and in a second mode in which an image of an original is formed with a second magnification which is different from the first magnification, comprising:

moving the electrophotographic photosensitive member at different speeds corresponding to the magnifications selected;

forming, prior to an image formation at the selected magnification, a test latent image with the corona discharging means operated at an initial reference current which is different in dependence on the modes; and detecting the potential of the test latent image and adjusting the current to the corona discharger in response to the detection of the potential.

2. A process according to claim 1, wherein the photosensitive member moves at a higher speed when the first mode is selected than when the second mode is selected, and wherein the current to the corona discharging means is greater when the first mode is selected than when the second mode is selected..

3. An electrophotographic process member which has been charged by a corona discharging means, wherein said process is selectively operable in a first mode in which an image of an original is formed with a first magnification, and in a second mode in which an image of an original is formed with a second magnification which is different from the first magnification, comprising:

moving the electrophotographic photosensitive member at a first speed when the first mode is selected, and at a second speed which is lower than the first speed when the second mode is selected; and controlling, prior to formation of an image of the original, the amount of discharge of the corona discharging means to cause the potential of the photosensitive member at a dark area to be a predetermined value; said controlling step including forming a test latent image with the corona discharging means operated by a reference current, wherein the initial value of said reference current is different in dependence on the mode selected, detecting the potential of the test latent image at the dark area thereof, and controlling the amount of discharge of the corona discharging means in response to the detection of the potential.

4. A process according to claim 3, wherein said predetermined value is different in dependence on the mode selected.

5. A process according to claim 4, wherein said predetermined value is higher when the first mode is selected than when the second mode is selected.

6. A process according to claim 3, 4 or 5, wherein the initial reference current is greater when the first mode is selected than when the second mode is selected.

11. A process according to claim 10, where said predetermined value for the dark area is different in dependence on the mode selected.

12. A process according to claim 11, where said predetermined value for the dark area is higher when the first mode is selected than when the second mode is selected.

10. An electrophotographic process for forming images on an electrophotographic photosensitive member which has been charged by a corona discharging means, wherein said process is selectively operable in a first mode in which an image of an original is formed with a first magnification, and in a second mode in which an image of an original is formed with a second magnification which is different from the first magnification, comprising:

moving the electrophotographic photosensitive member at a first speed when the first mode is selected, and at a second speed which is lower than the first speed when the second mode is selected; and controlling, prior to formation of an image of the original, the current to the corona discharging means to cause the potential of the photosensitive member at a dark area and a light area to be respective predetermined values; said controlling step including forming a test latent image with the corona discharging means operated by a reference current, wherein the initial value of said reference current is different in dependence on the mode selected, detecting the potentials of the test latent image at the dark and light areas thereof, and controlling the current to the corona discharging means in response to the detection of the potentials.

13. A process according to claims 10, 11 or 12, wherein the initial reference current is greater when the first mode is selected than when the second mode is selected.

14. A process according to claims 10, 11 or 12, wherein said predetermined value for the light area is common irrespective of the mode selected.

15. A process according to claim 14, wherein the initial reference current is greater when the first mode is selected than when the second mode is selected.

7. An electrophotographic process for forming images on an electrophotographic photosensitive member which has been charged by a corona discharging means, wherein said process is selectively operable in a first mode in which an image of an original is formed with a first magnification, and in a second mode in which an image of an original is formed with a second magnification which is different from the first magnification, comprising:

moving the electrophotographic photosensitive member at a first speed when the first mode is selected, and at a second speed which is lower than the first speed when the second mode is selected; and controlling, prior to formation of an image of the original, the amount of discharge of the corona discharging means to cause the potential of the photosensitive member at a light area to be a predetermined value; said controlling step including forming a test latent image with the corona discharging means operated by a reference current, wherein the initial value of said reference current is different in dependence on the mode selected, detecting the potential of the test latent image at the light area thereof, and controlling the amount of discharge of the corona discharging means in response to the detection of the potential.

8. A process according to claim 7, wherein said predetermined value is common irrespective of the mode selected.

9. A process according to claims 7 or 8, wherein the initial reference current is greater when the first mode is selected than when the second mode is selected.

16. An electrophotographic process for forming images on an electrophotographic photosensitive member which has been charged by a corona discharging means, wherein said process is selectively operable in a first mode in which an image of an original is formed with a first magnification, and in a second mode in which an image of an original is formed with a second magnification which is different from the first magnification, comprising:

moving the electrophotographic photosensitive member at a first speed when the first mode is selected, and at a second speed which is lower than the first speed when the second mode is selected; and forming, prior to formation of an image of the original, a test latent image with the corona discharging means operated by a reference current, when the first mode is selected;

making a first correction to the current to the corona discharging means, based on the test latent image; and controlling, when the second mode is selected, the current to the corona discharging means by making a second correction to the current which is the result of the first correction.

17. A process according to claim 16., wherein the second correction is made by multiplying the first corrected current by a predetermined coefficient.

18. A process according to claim 17, wherein said coefficient is the value obtained by dividing the second speed by the first speed.

19. A process according to claims 16, 17 or 18, wherein the magnification in the first mode is a unit magnification.

20. An electrophotographic process for forming images on an electrophotographic photosensitive member which has been charged by a corona discharging means, wherein said process is selectively operable in a first mode in which an image of an original is formed with a first magnification, and in a second mode in which an image of an original is formed with a second magnification which is different from the first magnification, comprising:

moving the electrophotographic photosensitive member at a first speed when the first mode is selected, and at a second speed which is different from the first speed when the second mode is selected; and controlling the amount of discharge of the corona discharging means when the first mode is selected, prior to formation of an image of the original, to cause the potential of the photosensitive member at a dark area to be a predetermined value; said controlling step including forming a test latent image with the corona discharging means operated by a reference current, detecting the potential of the test latent image at the dark area thereof, and controlling the current to the corona discharging means in response to the detection of the potential; and thereafter controlling, when the second mode is selected, the current to the corona discharging means so that a current flows having a value which is obtained by making a predetermined correction to the current obtained by said controlling step.

21. An electrophotographic process for forming images on an electrophotographic photosensitive member which has been charged by a corona discharging means, wherein said process is selectively operable in a first mode in which an image of an original is formed with a first magnification, and in a second mode in which an image of an original is formed with a second magnification which is different from the first magnification, comprising:

moving the electrophotographic photosensitive member at a first speed when the first mode is selected, and at a second speed which is different from the first speed when the second mode is selected; and controlling the amount of discharge of the corona discharging means when the first mode is selected, prior to formation of an image of the original, to cause the potential of the photosensitive member at a light area to be a predetermined value; said controlling step including forming a test latent image with the corona discharging means operated by a reference current, detecting the potential of the test latent image at the light area thereof, and controlling the current to the corona discharging means in response to the detection of the potential; and thereafter controlling, when the second mode is then selected, the current to the corona discharging means so that a current flows having a value which is obtained by making a predetermined correction to the current obtained by said controlling step.

22. An electrophotographic process for forming images on an electrophotographic photosensitive member which has been charged by a corona discharging means, wherein said process is selectively operable in a first mode in which an image of an original is formed with a first magnification, and in a second mode in which an image of an original is formed with a second magnification which is different from the first magnification, comprising:

moving the electrophotographic photosensitive member at a first speed when the first mode is selected, and at a second speed which is different from the first speed when the second mode is selected; and controlling the amount of discharge of the corona discharging means when the first mode is selected, prior to formation of an image of the original, to cause the potential of the photosensitive member at a dark area and a light area to be respective predetermined values; said controlling step including forming a test latent image with the corona discharging means operated by a reference current, detecting the potentials of the test latent image at the dark and light areas thereof, and controlling the current to the corona discharging means in response to the detection of the potentials; and controlling, when the second mode is thereafter selected, the current to the corona discharging means so that a current flows having a value which is obtained by making a predetermined correction to the current obtained by said controlling step.

23. A process according to claims 20, 21 or 22, wherein the magnification in the first mode is a unit magnification.

24. A process according to claim 23, wherein said predetermined correction is made by multiplying the current obtained in the first mentioned controlling step by a predetermined coefficient.

25. A process according to claim 23, wherein said coefficient is the value obtained by dividing the second speed by the first speed.

26. A process according to claim 23, further comprising memorizing the current obtained in the first mentioned controlling step, and when the second mode is selected, making said predetermined correction to the memorized value.

27. A process according to claim 26, wherein said predetermined correction is made by multiplying the memorized value by a predetermined coefficient.

28. A process according to claim 27 wherein said coefficient is the value obtained by dividing the second speed by the first speed.

* * * * *

UNITED STATES PATENT AND TRADEMARK OFFICE

CERTIFICATE OF CORRECTION

PATENT NO. : 4,480,909

DATED : November 6, 1984

INVENTOR(S) : HIROAKI TSUCHIYA

It is certified that error appears in the above-identified patent and that said Letters Patent is hereby corrected as shown below:

COLUMN 1

Line 21, after "electric" insert --potential--.

Lines 63 and 64, "come out" should read --occur--.

COLUMN 2

Line 17, after "control" delete "same".

Line 60, after "made" insert --to--.

COLUMN 4

Line 35, "details" should read --detail--.

Lines 66 and 67, before and after "respectively" insert --,--.

COLUMN 6

Line 41, "image" should read --images--.

COLUMN 7

Line 11, "image" should read --images--.

Line 44, delete "to".

COLUMN 8

Line 7, "respectively. The" should read --respectively, the--.

UNITED STATES PATENT AND TRADEMARK OFFICE

CERTIFICATE OF CORRECTION

PATENT NO. : 4,480,909

DATED : November 6, 1984

INVENTOR(S) : HIROAKI TSUCHIYA

It is certified that error appears in the above-identified patent and that said Letters Patent is hereby corrected as shown below:

COLUMN 8 (Continued)

Line 19, delete "out".

Line 32, after "output" insert --values--.

Signed and Sealed this

*Fifteenth* Day of *October 1985*

[SEAL]

*Attest:*

*Attesting Officer*

DONALD J. QUIGG

*Commissioner of Patents and Trademarks—Designate*